US008374754B2

(12) United States Patent
Clodfelter

(10) Patent No.: US 8,374,754 B2
(45) Date of Patent: Feb. 12, 2013

(54) APPARATUS FOR DETECTING SUBSURFACE OBJECTS WITH A REACH-IN ARM

(75) Inventor: James F. Clodfelter, Sterling, VA (US)

(73) Assignee: NIITEK, Inc., Dulles, VA (US)

( * ) Notice: Subject to any disclaimer, the term of this patent is extended or adjusted under 35 U.S.C. 154(b) by 1279 days.

(21) Appl. No.: 11/634,793

(22) Filed: Dec. 5, 2006

(65) Prior Publication Data

US 2007/0260378 A1 Nov. 8, 2007

Related U.S. Application Data

(60) Provisional application No. 60/742,046, filed on Dec. 5, 2005.

(51) Int. Cl.
*G06F 17/00* (2006.01)

(52) U.S. Cl. ..... 701/48; 342/118; 901/1

(58) Field of Classification Search ..... 280/789; 414/917, 967; 250/349, 392; 700/258, 245; 324/326, 337; 701/48; 342/118, 122, 22; 73/856; 901/7

See application file for complete search history.

(56) References Cited

U.S. PATENT DOCUMENTS

| | | | |
|---|---|---|---|
| 2,205,073 | A | 6/1940 | Smit |
| 2,303,744 | A | 12/1942 | Jacobs |
| 2,627,676 | A | 2/1953 | Hack |
| 2,720,714 | A | 10/1955 | Flynn et al. |
| 2,990,026 | A | 6/1961 | Albee |
| 3,061,951 | A | 11/1962 | Barron |
| 3,243,898 | A | 4/1966 | Lewis, Jr. et al. |
| 3,318,024 | A | 5/1967 | Fujinaka et al. |
| 3,516,181 | A | 6/1970 | Jordan |
| 3,626,804 | A | 12/1971 | Paramythioti |
| 3,733,721 | A | 5/1973 | Clemens |
| 3,771,413 | A | 11/1973 | Sieg et al. |
| 4,089,565 | A | 5/1978 | Loegering et al. |
| 4,098,011 | A | 7/1978 | Bowerman et al. |

(Continued)

FOREIGN PATENT DOCUMENTS

| | | |
|---|---|---|
| CA | 2 234 597 | 10/1999 |
| DE | 38 41 303 | 6/1990 |

(Continued)

OTHER PUBLICATIONS

English language abstract of DE 38 41 303, published Jun. 13, 1990.

(Continued)

*Primary Examiner* — Ronnie Mancho

(74) *Attorney, Agent, or Firm* — Finnegan, Henderson, Farabow, Garrett & Dunner, L.L.P.

(57) ABSTRACT

An apparatus for detecting objects on or beneath a surface of a medium having a reach-in arm, the base of the reach in arm connected to a platform, and the distal end of the reach-in arm connected to a sensor. The sensor detects objects on or beneath the surface of a medium and is capable of monitoring the distance of the sensor from objects in the path of the sensor. Motor controllers are connected to the reach-in arm and the sensor for controlling the movements of the reach-in arm and sensor. A computer is in communication with the reach-in arm, the sensor, and the motor controllers. The computer detects objects on or beneath the surface of a medium; determines the location of the reach-in arm and sensor relative to objects in their paths; and controls the movement of the reach-in arm and sensor either automatically using pre-programmed software or according to user inputted commands.

23 Claims, 5 Drawing Sheets

U.S. PATENT DOCUMENTS

| | | | | |
|---|---|---|---|---|
| 4,135,188 | A | 1/1979 | Bickley, Jr. et al. | |
| 4,194,310 | A | 3/1980 | Bowerman | |
| 4,234,941 | A | 11/1980 | Welland, Jr. et al. | |
| 4,249,588 | A | 2/1981 | Egan | |
| 4,378,643 | A | 4/1983 | Johnson | |
| 4,489,405 | A | 12/1984 | Tendler | |
| 4,525,941 | A | 7/1985 | Ruth, Jr. | |
| 4,565,412 | A | 1/1986 | Comminge et al. | |
| 4,590,123 | A | 5/1986 | Hashimoto et al. | |
| 4,611,411 | A | 9/1986 | Ringler et al. | |
| 4,616,350 | A | 10/1986 | Tendler | |
| 4,621,348 | A | 11/1986 | Tendler | |
| 4,672,590 | A | 6/1987 | Tendler | |
| 4,676,009 | A | 6/1987 | Davis et al. | |
| 4,723,585 | A | 2/1988 | Mechtel | |
| 4,773,298 | A | 9/1988 | Tischer et al. | |
| 4,870,687 | A | 9/1989 | DeLeon | |
| 4,909,128 | A | 3/1990 | Grinwald | |
| 4,972,379 | A | 11/1990 | Harris, Jr. | |
| 5,002,109 | A | 3/1991 | Shepler et al. | |
| 5,007,325 | A | 4/1991 | MacWatt | |
| D319,138 | S | 8/1991 | Hart | |
| 5,176,765 | A | 1/1993 | Yamaguchi et al. | |
| 5,189,243 | A | 2/1993 | Hambric | |
| 5,198,608 | A | 3/1993 | Cahill et al. | |
| 5,301,441 | A | 4/1994 | Kownacki | |
| 5,327,139 | A | 7/1994 | Johnson | |
| 5,351,734 | A | 10/1994 | Mouri et al. | |
| 5,420,589 | A | 5/1995 | Wells et al. | |
| 5,592,170 | A | 1/1997 | Price et al. | |
| 5,631,835 | A | 5/1997 | Hagenbuch | |
| 5,663,520 | A | 9/1997 | Ladika et al. | |
| 5,711,139 | A | 1/1998 | Swanson | |
| 5,786,542 | A | 7/1998 | Petrovich et al. | |
| 5,892,360 | A | 4/1999 | Willer et al. | |
| 5,896,680 | A | 4/1999 | Kim et al. | |
| 5,900,833 | A | 5/1999 | Sunlin et al. | |
| 5,926,977 | A | 7/1999 | Sanders | |
| 5,930,200 | A | 7/1999 | Kabel | |
| 5,979,289 | A | 11/1999 | French | |
| 5,979,290 | A | 11/1999 | Simeone | |
| 5,988,037 | A | 11/1999 | Haughom et al. | |
| 5,992,056 | A | 11/1999 | Lohrmann | |
| 6,006,646 | A | 12/1999 | Makris et al. | |
| 6,029,558 | A | 2/2000 | Stevens et al. | |
| 6,082,024 | A | 7/2000 | Del Biondi | |
| 6,094,157 | A | 7/2000 | Cowdrick | |
| 6,115,945 | A | 9/2000 | Ellis, III | |
| 6,128,999 | A | 10/2000 | Sepp et al. | |
| 6,212,799 | B1 | 4/2001 | Gingerich et al. | |
| 6,279,631 | B1 | 8/2001 | Tuggle | |
| 6,297,449 | B1 | 10/2001 | Dagtekin | |
| 6,333,631 | B1 * | 12/2001 | Das et al. | 324/326 |
| 6,377,872 | B1 * | 4/2002 | Struckman | 700/258 |
| 6,396,433 | B1 | 5/2002 | Clodfelter | |
| 6,445,334 | B1 | 9/2002 | Bradley et al. | |
| 6,478,387 | B1 | 11/2002 | Rayman | |
| 6,505,421 | B1 | 1/2003 | Vaz | |
| 6,636,581 | B2 * | 10/2003 | Sorenson | 378/58 |
| 6,655,051 | B1 | 12/2003 | Peche et al. | |
| 6,657,577 | B1 | 12/2003 | Gregersen et al. | |
| 6,666,124 | B2 | 12/2003 | Fleming | |
| 6,690,316 | B2 | 2/2004 | Yankielun | |
| 6,725,572 | B1 | 4/2004 | Krstic | |
| 6,751,892 | B2 | 6/2004 | Chavet et al. | |
| 6,785,357 | B2 * | 8/2004 | Bernardi et al. | 378/57 |
| 6,838,671 | B2 * | 1/2005 | Compana et al. | 250/349 |
| 6,915,728 | B2 | 7/2005 | Renwick et al. | |
| 6,952,990 | B1 | 10/2005 | Clodfelter | |
| 7,042,385 | B1 | 5/2006 | Wichmann | |
| 7,113,081 | B1 | 9/2006 | Reichow et al. | |
| 7,190,302 | B2 | 3/2007 | Biggs | |
| 7,467,810 | B2 * | 12/2008 | Leggatt | 280/789 |
| 7,479,918 | B2 | 1/2009 | Johnson et al. | |
| 7,486,768 | B2 * | 2/2009 | Allman et al. | 378/57 |
| 7,511,654 | B1 | 3/2009 | Goldman et al. | |
| 7,660,386 | B2 * | 2/2010 | Meng et al. | 378/57 |
| 2002/0027521 | A1 | 3/2002 | Clodfelter | |
| 2002/0175849 | A1 | 11/2002 | Arndt et al. | |
| 2003/0172554 | A1 | 9/2003 | Chavet et al. | |
| 2003/0193429 | A1 | 10/2003 | Campana et al. | |
| 2003/0196543 | A1 * | 10/2003 | Moser et al. | 89/1.13 |
| 2004/0251698 | A1 | 12/2004 | Welch et al. | |
| 2005/0062639 | A1 | 3/2005 | Biggs | |
| 2005/0128125 | A1 | 6/2005 | Li et al. | |
| 2006/0050929 | A1 | 3/2006 | Rast et al. | |
| 2006/0056584 | A1 | 3/2006 | Allman et al. | |
| 2006/0130593 | A1 * | 6/2006 | Richards et al. | 73/856 |
| 2006/0225900 | A1 | 10/2006 | Kimball | |
| 2006/0267296 | A1 | 11/2006 | Dodd et al. | |
| 2007/0260378 | A1 | 11/2007 | Clodfelter | |

FOREIGN PATENT DOCUMENTS

| | | |
|---|---|---|
| JP | 6-74695 | 3/1994 |
| WO | WO 02/03007 | 1/2002 |

OTHER PUBLICATIONS

English language abstract of JP 6-74695, published Mar. 18, 1994.
Machine English language translation of JP 6-74695, published Mar. 18, 1994.
Office Action issued Jun. 10, 2009 in U.S. Appl. 11/977,582.
International Search Report issued in International Application No. PCT/US2008/71846, mailed Oct. 22, 2008.
Written Opinion issued in International Application No. PCT/US2008/71846, mailed Oct. 22, 2008.
Notice of Allowanced issued in related U.S. Appl. No. 11/977,582 on Nov. 16, 2009.
U.S. Appl. 09/828,937, as of Mar. 14, 2011.
U.S, Appl. 10/244,007 as of Mar. 14, 2011.
U.S. Appl. 11/977,582 as of Mar. 14, 2011.
U.S. Appl. 12/184,167 as of Mar. 14, 2011.
Office Action from U.S. Appl. No. 12/184,167, mailed Aug. 3, 2011 by the U.S. Patent and Trademark Office (7 pages total).

* cited by examiner

APPARATUS FOR DETECTING SUBSURFACE OBJECTS WITH A REACH-IN ARM

CROSS REFERENCE TO RELATED APPLICATIONS

The present application claims the benefit of U.S. Provisional Application Ser. No. 60/742,046 filed Dec. 5, 2005 which is incorporated herein by reference.

BACKGROUND

Apparatuses for detecting subsurface objects have been used to detect concealed objects including, without limitation, hidden bombs, narcotics, cables, pipes, and corpses. Such apparatuses also have been used to facilitate subsurface detection in various technology areas, such as for motion detection, seeing-through walls, archeology, and geology. Most notably, however, such apparatuses are used to detect land mines. While apparatuses for detecting subsurface objects, including the invention described herein, may be advantageously employed in various applications, the invention is described herein, in terms of an apparatus for the detection of land mines, with no intent of limitation.

Since 1975, land-mines have exploded under more than 1 million people and are currently thought to be killing approximately 800 people a month. In 64 countries around the world, there are an estimated 110 million land-mines still lodged in the ground. They remain active for decades-years after wars have ended. As such, a large worldwide community has devoted extensive resources to ridding the world of both future and currently placed land mines. Mine detecting technology has been invaluable to this endeavor and has been responsible for preventing the loss of many lives.

There are currently at least four types of mine detection machines available: 1) vehicle mounted; 2) handheld; 3) airborne; and 4) mechanical clearing devices such as rollers, plows, or flails. These mine detection machines detect surface and subsurface anti-tank ("AT") mines and anti-personnel ("AP") mines. An AT mine is a type of land mine designed to damage or destroy vehicles, whereas an AP mine is used against humans.

Vehicle mounted detection systems employ one of many sensor technologies to help "see" or detect the mines. Two types of vehicle mounted mine detection systems are shown in FIGS. 1 and 2. For the most part, these vehicle mounted mine detection systems are AT mine overpass and thus will typically not detonate an AT mine because the ground pressure is low enough not to trigger the AT mines. However, all of these AT-overpass vehicle mounted mine detection systems can easily detonate an AP mine. Once a mine is detonated—whether AP or AT—the explosion can severely damage sensors and other parts of the vehicle that are carrying the sensors. The repair and replacement of damaged sensors and vehicle parts is very expensive. Moreover, unless the vehicle is remotely controlled, the operator of the vehicle is in danger of being hit by shrapnel emitted from the exploded mine and the ensuing damaged sensor and vehicle.

The other three types of mine detection machinery also have some disadvantages. Specifically, the use of handheld sensors puts the soldier or de-miner directly in harms way as missed mines can detonate when stepped upon. Moreover, enemy fire may be directed toward the soldier engaged in de-mining. Airborne detection systems have a low probability of detection being too far away from the ground to accurately detect the mines, and as such are not very effective. Mechanical clearing devices such as rollers, plows, and flails are not 100% effective and tend to leave the land in a fragile state by destroying structures and vegetation in the path of detection. This destruction is of particular concern in desert land which has very limited vegetation, such vegetation taking years to develop in remote areas of the arid environment. Moreover, if these mechanical clearing devices detonate an AT mine, they are often damaged beyond repair.

As such, there remains a need for an improved apparatus for detecting subsurface objects such as landmines that is safe and accurate and that concurrently minimizes damage to the environment, sensor and apparatus.

SUMMARY

The present invention is directed to an apparatus for detecting subsurface objects that satisfies the need for improving the safety, performance, and damage control of the apparatus. In accordance with one embodiment of the present invention, an apparatus for detecting subsurface objects of the present invention comprises a platform and a reach-in arm, the base of the reach-in arm mounted to the platform. The distal end of the reach-in arm is connected to a sensor for sensing objects on or beneath a surface of a medium. At least one motor controller is electronically connected to the reach-in arm and to the sensor for controlling the movements of the reach-in arm and the sensor. The reach-in arm, the sensor, and the motor controller are in communication with a computer. The computer processes data received from the sensor to detect objects on or beneath the surface of a medium, and controls the movement of the reach-in arm and the movement of the sensor.

In accordance with an alternate embodiment of the invention, the platform comprises a vehicle. In another embodiment of the invention, the reach-in arm includes but is not limited to a telescopic arm, an articulating arm, and a conveyor system. In accordance with an alternate embodiment of the invention, the reach-in arm comprises a plurality of segments. Each segment is connected to another segment by way of a joint. The joint is in communication with a computer and provides the computer with the location of the reach-in arm and the sensor relative to the objects surrounding the reach-in arm and the sensor. The computer uses the data to control the direction of the reach-in arm and the sensor. In accordance with an alternate embodiment of the invention, the reach-in arm is connected to the sensor by a quick-connect interface. The quick-connect interface comprises a contact switch breakaway system and a spring mechanism. In yet another embodiment of the invention, a second reach-in arm is coupled to the platform. The base of the second reach-in arm is mounted to the platform. The second reach-in arm is for investigating the area being explored by the sensor.

In accordance with an alternate embodiment of the invention, the sensor comprises a first and second sensor. The first sensor is for sensing objects on or beneath the surface of a medium. The second sensor is for monitoring the distance of the first sensor from an object in the path of the first sensor. The second sensor is in communication with the computer. The computer processes data from the second sensor to determine the distance between the sensors and objects in the path of the sensors. In accordance with yet another embodiment of the invention, the second sensor for monitoring distances, can be a separate device from the first sensor.

In accordance with an alternate embodiment of the invention, the computer can be connected wirelessly to the reach-in arm, the sensor, and the motor controllers. In accordance with another embodiment of the invention, the apparatus further comprises a display device in communication with the computer. The display device displays sensing data provided by the sensor. In accordance with an embodiment of the invention, the apparatus further comprises an input device in communication with the computer. The input device transmits instructions to the computer for controlling and moving the reach-in arm and the sensor.

In accordance with an additional embodiment of the invention, the apparatus further comprises a camera for capturing images of an area explored by a sensor. The camera is mounted onto the distal end of said reach in arm. In a variant embodiment, the camera is capable of night-vision.

In accordance with yet another embodiment of the invention, the system further comprises a marking system connected to the reach-in arm. The marking system marks the surface of a medium where an object is located. The marking system is in communication with the computer. The computer controls the marking system and specifically directs the marking system to mark a particular surface of a medium on or under which an object is located.

In accordance with further embodiments of the invention, a method is provided for detecting objects on or beneath a surface of a medium that comprises providing a platform having a reach-in arm mounted to the platform; providing a sensor for detecting an object on or beneath a surface of a medium where the sensor is connected to the reach-in arm; moving the reach-in arm in a specified direction to position the sensor over a surface of a medium; and moving the sensor in a specified direction over the surface of a medium in search of an object on or beneath a surface of the medium. In accordance with another embodiment of the invention, the specified direction comprises moving the reach-in arm in a programmed sweep direction, and moving the reach-in arm in a user defined direction around the platform.

In accordance with yet a further embodiment of the invention, the method comprises providing a second sensor for monitoring the distance between the sensor from an object in the path of the sensor; determining the distance between the sensor and the object in the path of the sensor; and moving the reach-in arm and sensor in a specified direction in relation to the object in the path of the sensor.

In accordance with yet another embodiment of the invention, the method further comprises providing a marking system coupled to the reach-in arm and the sensor; detecting an object on or beneath the surface of a medium; moving the reach-in arm in a specified direction in relation to the object; moving the sensor in a specified direction in relation to the object; marking the surface of the medium on or beneath which is located the object. In accordance with an alternate embodiment of the invention, the method further comprises providing override capabilities to a user, wherein the user will provide instructions for the direction of moving the reach-in arm or sensor by inputting instructions into an input device in communication with the computer that controls the reach-in arm and the sensor.

These and other features, aspects, and advantages of the present invention will become better understood with reference to the following description and appended claims.

DESCRIPTION OF THE DRAWINGS

Embodiments of the present invention will be described with reference to the attached drawings in which like components or features in the various figures are represented by like reference numbers.

DESCRIPTION

With reference to the figures, exemplary embodiments of the invention are now described. These embodiments illustrate principles of the invention and should not be construed as limiting the scope of the invention.

Figure 1:
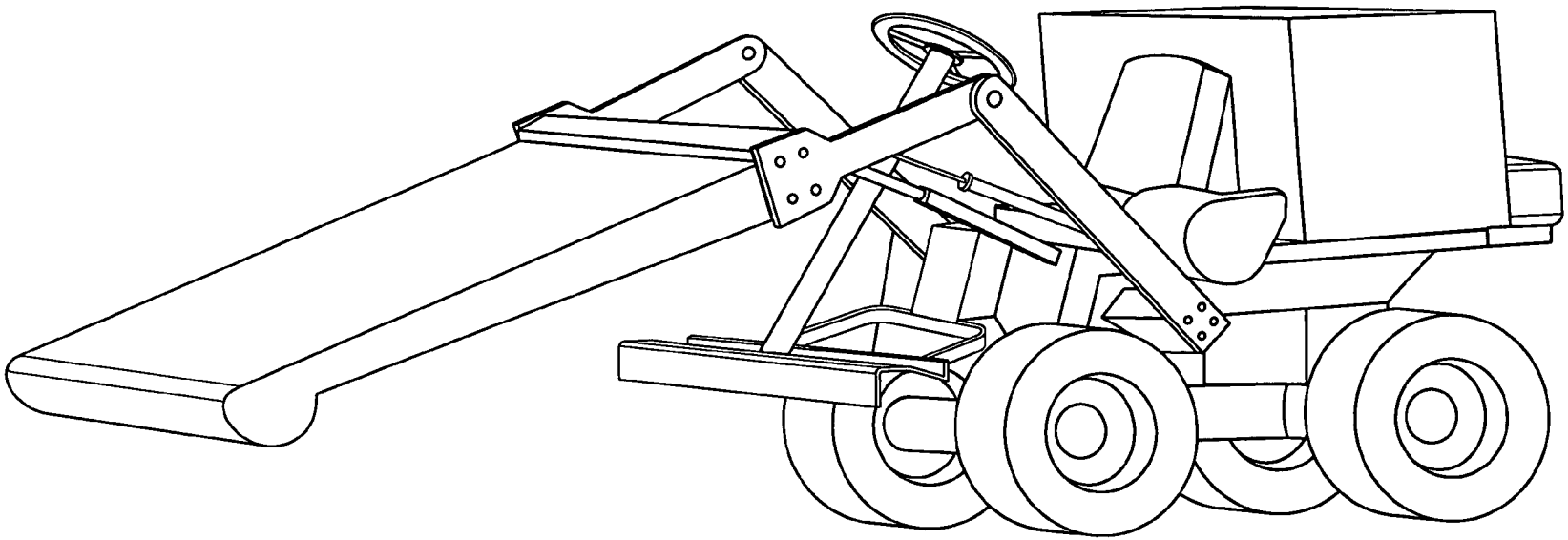
FIG. 1 is a perspective view of a currently available vehicle mounted mine detector.
Figure 2:
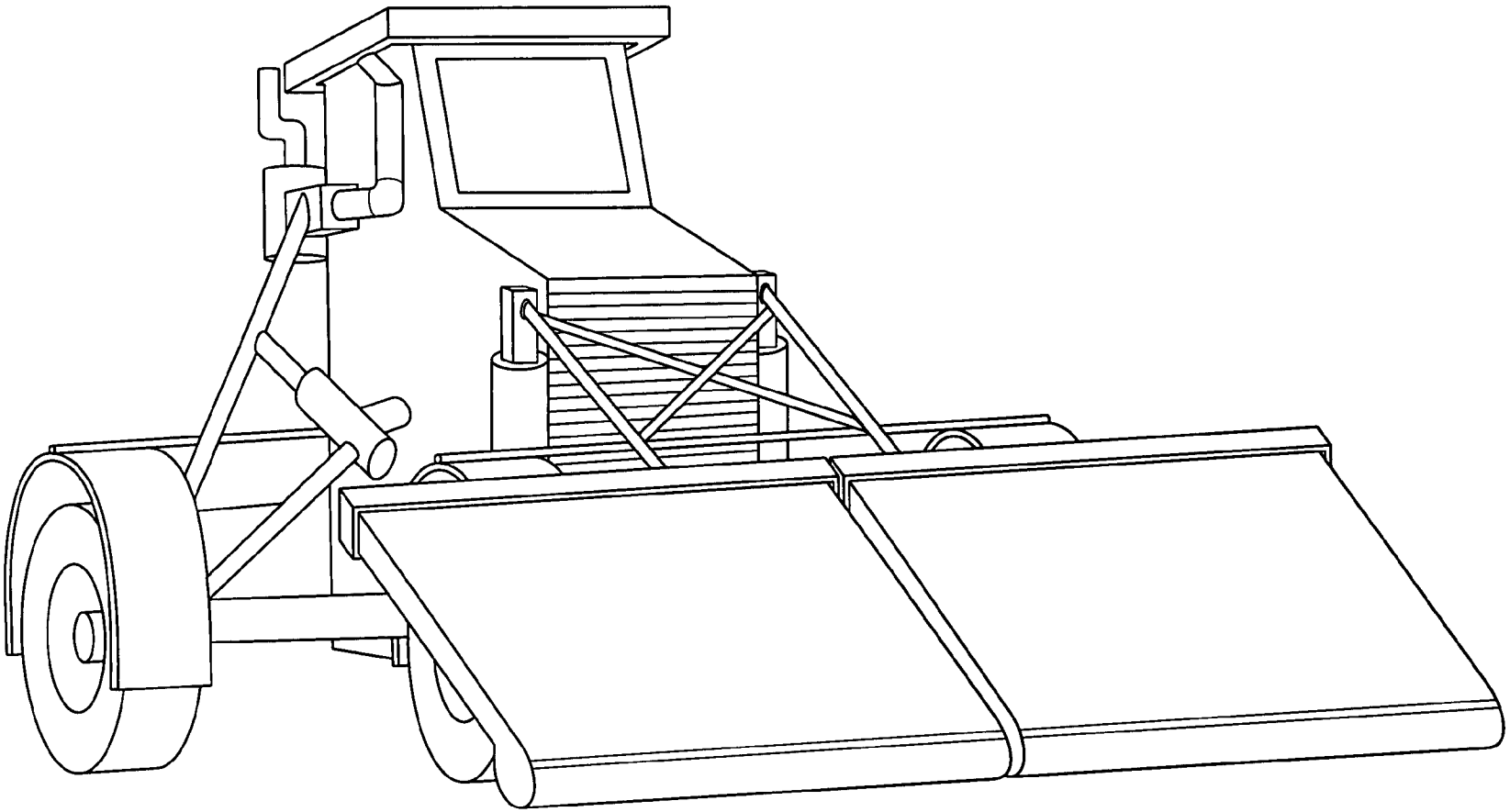
FIG. 2 is a perspective view of an additional currently available vehicle mounted mine detector.
Figure 3:
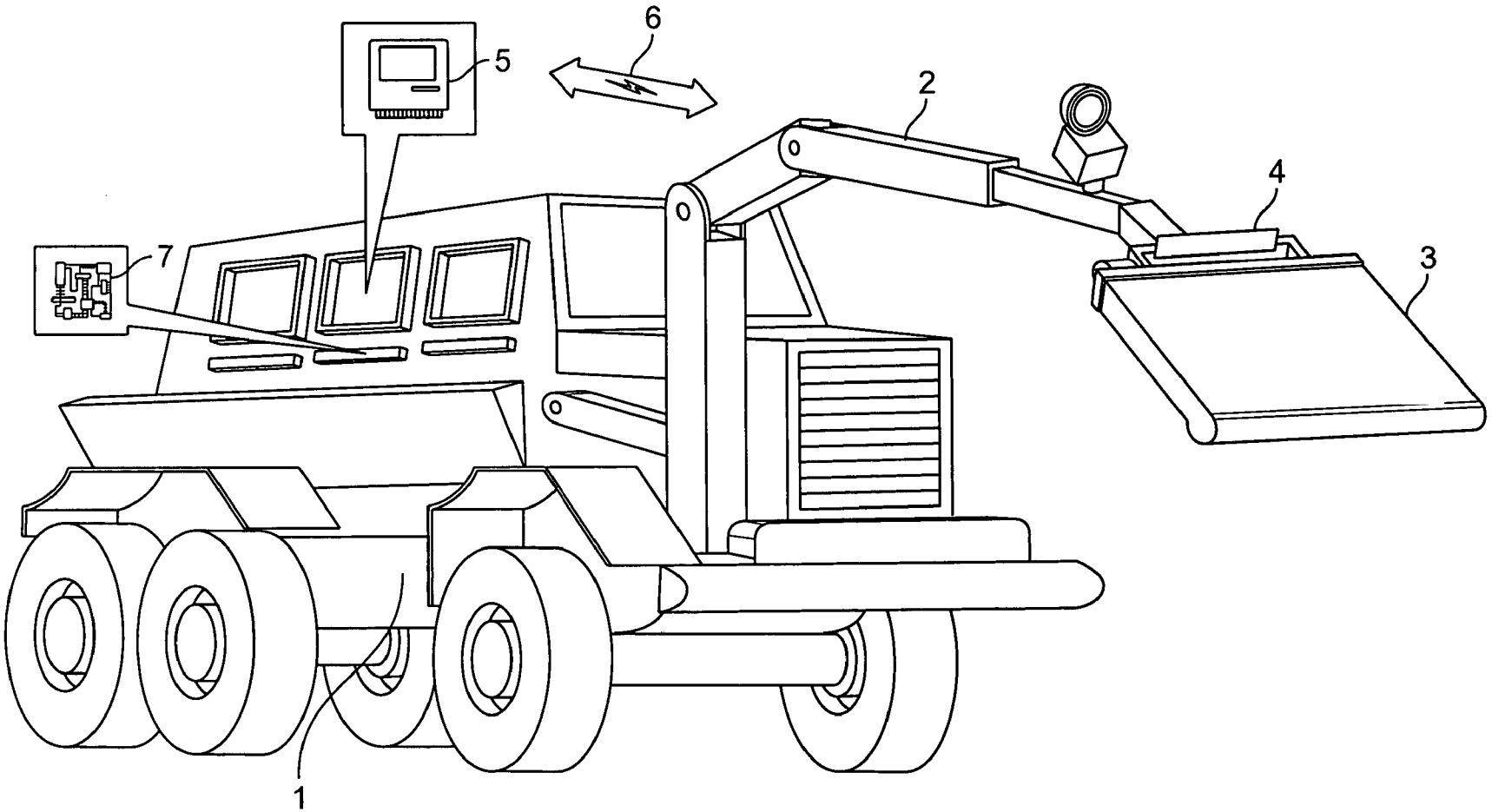
FIG. 3 is a perspective view of an embodiment of the invention.

An exemplary embodiment of the invention is illustrated in FIG. 3. FIG. 3 shows an apparatus for detecting objects on or beneath a surface of a medium comprising a reach-in arm 2 connected to a platform 1; a sensor 3 connected to the distal end of the reach-in arm 2 by way of a quick-connect interface 4; a motor controller 7 electronically connected to the reach-in arm 2 and the sensor 3; and a computer 5 in communication with the reach-in arm 2, the sensor 3, and the motor controller 7.

The platform 1 can be a vehicle as shown in FIG. 3, or a tank, an unmanned cart, a land mine pressure avoidance apparatus such as that found in U.S. Pat. No. 6,952,990, issued to applicant, the disclosure of which is incorporated herein by reference, and similar such vehicles or platforms. The reach-in arm 2 can be mounted to the platform 1 in any number of conventionally known manners, including but not limited to bolted, clamped, and pinned manners. Examples of a reach-in arm 2 include but are not limited to a telescopic arm, an articulating arm, or a conveyor system. The quick connect interface 4 that connects the reach-in arm 2 to the sensor 3 includes any conventional quick connect devices well known in the art, including but not limited to a breakaway system and a spring mechanism. The sensor 3 is for sensing objects on or beneath the surface of a medium and examples of such sensors include but are not limited to those described in U.S. Pat. No. 7,042,385 and U.S. Pat. No. 6,396,433, both issued to applicant, the disclosures of which are incorporated herein by reference, Ground Penetrating Radars ("GPRs"), metal detectors, seismic detectors, accoustic detectors, quadrupole resonance images, and other conventionally known sensor types. The motor controller 7 that is electronically connected to the reach-in arm 2 and the sensor 3, comprises any conventional device or group of devices known to the skilled artisan for controlling the movement of capable of governing the performance of the reach-in arm and the sensor 3. The motor controller 7 can be any conventionally known movement mechanism, including but not limited to electric, hydraulic, and pneumatic movement mechanisms. The motor controller 7 comprises a conventional motor or motors that operates the reach-in arm 2 and the sensor 3. The computer 5 processes data received from the reach-in arm 2 and the sensor 3 and controls the movement of the reach-in arm 2 and the sensor 3. The computer 5 runs software that detects subsurface objects and determines the position and direction of the reach-in arm 2 and the sensor 3, such software including but not limited to known automatic target recognition algorithms that detect and discriminate subsurface objects; and conventional software applicable to detect and process sensor data and positioning data to control and move the reach-in arm 2 and the sensor 3. The computer 5 may be in wire or wireless communication 6 with reach-in arm 2, sensor 3, and motor controller 7.

Figure 4:
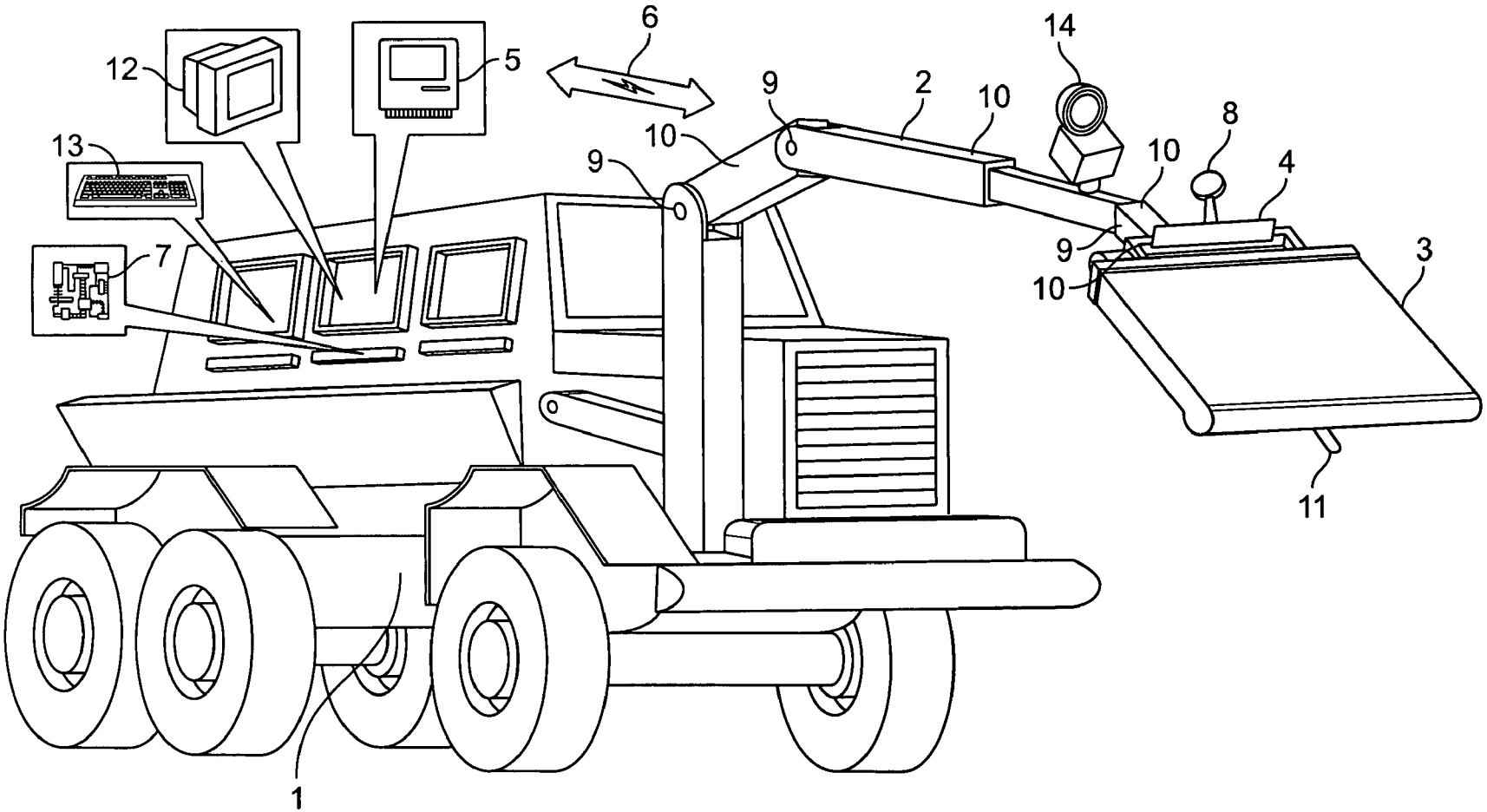
FIG. 4 is a perspective view of yet another embodiment of the invention.

Another embodiment of the invention is illustrated in FIG. 4. FIG. 4 shows the reach-in arm 3 comprised of various segments 10 connected to each other by joints 9. The joints 9 are electronically coupled to computer 5 and provide computer 5 with angular or linear position status data as is known in the field of robotics. The computer 5 processes the angular or linear position data to determine the location of each of the segments 10 of the reach-in arm 2. The computer 5 processes the distance data to determine the direction to move each of the segments 10. The joints 9 are conventional robotics connecting mechanisms known in the art including but not limited to angular, linear, ball, and hinge connections and the like. The segments 10 can be made of metal, wood, plastic, composite, or any other conventional segment material sufficient to dynamically support the sensor at the distal end.

FIG. 4 shows a further embodiment of the invention including a second sensor 8 coupled to a sensor 3. This second sensor 8 is for monitoring the distance of the sensor 3 from objects in the path of the sensor 3. The second sensor 8 is a three-dimensional measuring device including but not limited to a LIDAR, LASER, ultrasound, radar, acoustic, and similar such measuring devices. The second sensor 8 is in communication 6 with computer 5. The computer 5 processes distance data sent by the second sensor 8 in order to monitor the distance of the sensors from objects in the path of the sensors. The computer 5 runs software conventionally programmed to process distance data provided by the sensor 8 to determine the distances between the sensors 3 and 8 and objects in their path. In an alternate embodiment, the sensor 3 can function both as a sensor for sensing objects on or beneath a surface and for monitoring the distance of the sensor from objects in its path without the need for a separate sensor.

With further reference to FIG. 4, another embodiment of the invention comprises a marking system 11 connected to the reach-in arm 2. The marking system 11 is for marking a location of a subsurface object on a surface of a medium and includes conventional marking systems such as paint spray, flag, token, GPS-tagging, and the like. Such a marking system 11 can mark a surface of a medium using conventional methods including the use of a jet, pointable jet, or marking array that uses liquid, powder, foam, or mechanical markers (poker chips). The marking system 11 is in communication 6 with computer 5. The computer 5 controls the marking system 11 and directs the marking system 11 to mark a location of a subsurface object should such an object be detected. The computer 5 runs software conventionally applicable to process received position information to determine when and where to mark the location of a subsurface object on the surface of a medium.

With reference to FIG. 4, another embodiment of the present invention comprises a display device 12 in communication 6 with computer 5. The display device 12 displays data including but not limited to the sensor 3 view of a medium or an object, an area to be searched, a location of the sensor 3 relative to other objects in its path, and other conventionally provided information. The display device 12 includes but is not limited to conventional display devices such as CRT monitors, LCD or plasma monitors, screens, touch-screen, or the like.

FIG. 4 also shows another embodiment of the present invention comprising an input device 13. The input device 13 can be any conventional input device including but not limited to a computer keyboard, a mouse, a touch screen, a touch pad, and the like. The input device 13 is in communication with computer 5. The input device 13 transmits inputted instructions to computer 5 for controlling the reach-in arm 2 and the sensor 3.

FIG. 4 also shows another aspect of the present embodiment where a camera 14 is mounted onto the distal end of the reach-in arm 2. The camera 14 captures images of an area explored by a sensor. The camera can be any conventional camera that takes both still and moving images. In a variant embodiment, the camera is capable of night-vision.

Figure 5:
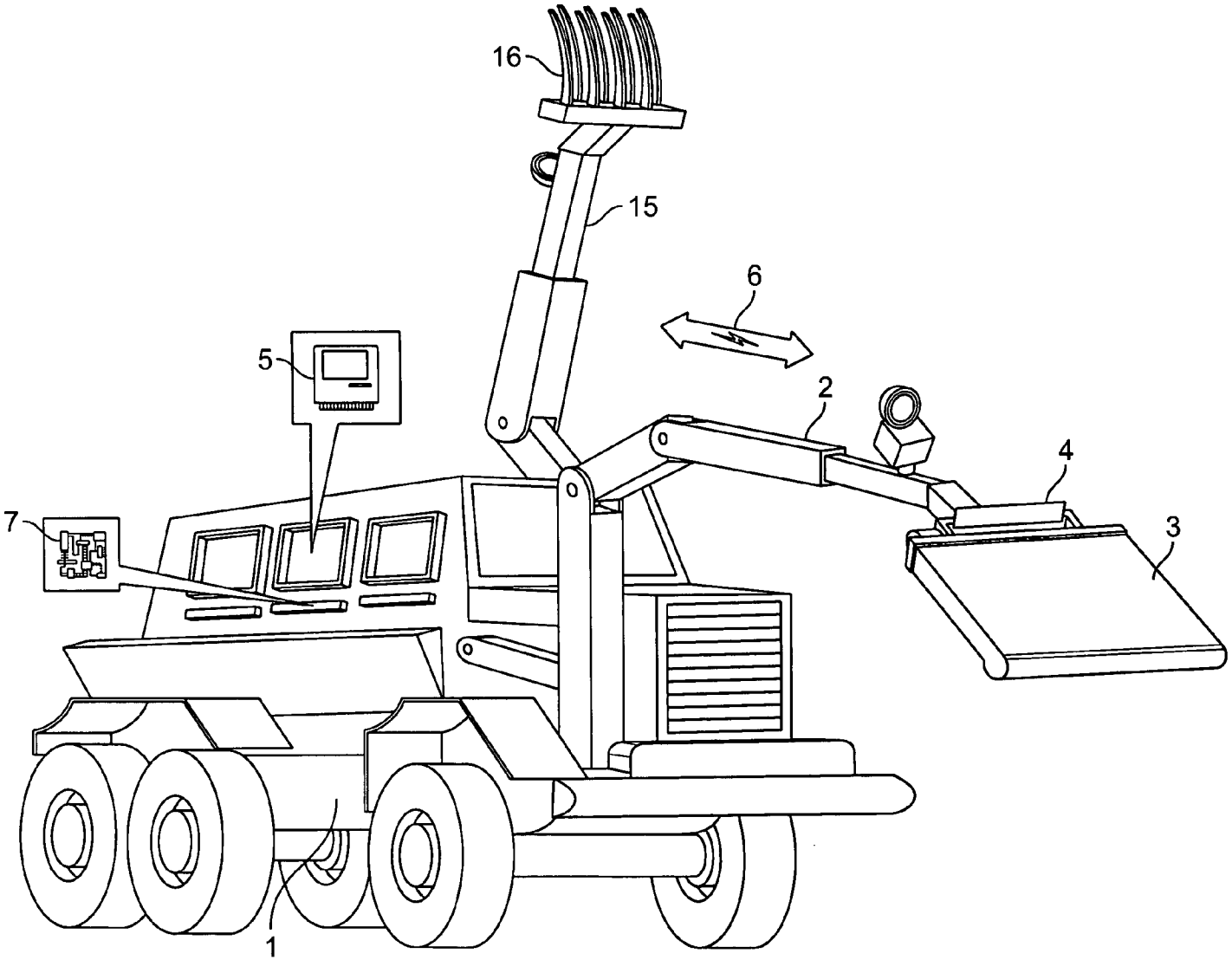
FIG. 5 is a perspective view of the apparatus of FIG. 3 having a second reach-in arm for investigating an area.

A further embodiment in accordance with the present invention is shown in FIG. 5. FIG. 5 shows a second reach-in arm 15 coupled to the platform 1, the second reach-in arm 15 having an investigating mechanism 16 connected to the distal end of the second reach-in arm 15. The second reach-in arm 15 can be a backhoe-arm or such a like arm, and the investigating mechanism 16 includes but is not limited to a probe, a claw, a talon, a thumb, a weight, and such conventionally known like mechanisms for investigating an area being explored by the sensor 3. The second-reach in arm 15 investigates an area being explored by the sensor 3. Such investigations include but are not limited to moving objects in the path of sensor 3, tearing down or moving obstructions and structures such as walls or fences; poking holes in walls or fences; and lifting impediments in the path of platform 1.

An exemplary embodiment of the invention provides a method for detecting objects on or beneath the surface of a medium using a platform comprising a reach-in arm mounted to the platform and a sensor mounted to the reach-in arm. A computer moves the reach-in arm and the sensor in a specified direction over the surface of a medium. The specified direction is determined by a computer that directs the motion of the reach-in arm and the sensor in accordance with either preprogrammed software running on the computer; or by processing instructions received from a user or operator through an input device. Such specified directions include moving the sensor and reach-in arm in a sweep direction; moving the sensor and reach-in arm in a user-defined area and direction; moving the sensor and reach-arm to maintain a pre-set height above the ground; moving the sensor and reach-in arm in an area and direction according to known polygon-fill techniques that allow for the automatic sensing of a particular area. Such a polygon-fill technique includes, manually selecting an area to be swept, and automatically and efficiently sweeping the entire selected area without the need for operator or user intervention. The computer receives object data from the sensor and uses conventional target recognition software to determine the existence of a subsurface object and also to detect surface objects. Such objects include but are not limited to explosive hazards (mines and improvised explosives) and underground infrastructure such as pipes, wires, tunnels, rebar, and the like.

In a further embodiment of the present invention, the method comprises providing a computer that receives distance data from a sensor. The computer uses the data for monitoring the distance between the sensor and objects in the path of the sensor. The computer processes this data and moves the reach-in arm and sensors in specified directions. The specified directions include a direction away from the object in the path of the sensor. The specified directions include maintaining a pre-determined distance, such as a certain height, from an object or medium, such as the ground.

In another embodiment of the invention, the method further comprises providing a marking system coupled to said reach-in arm and said sensor. Using the sensor, the computer detects a subsurface object on the surface of a medium. The computer instructs the marking system to mark the surface of the medium on or under which is the object.

Yet another embodiment of the invention further comprises a method for overriding automatic computer instructions by allowing a user or operator to input instructions directly into a input device connected to a computer, instructing the computer to move the reach-in arm and the sensor in a manner desired by the user or operator, and to mark the surface of any area chosen by the user or operator.

The previously described versions of the present invention have many advantages, including but not limited to a safer, more accurate way of detecting subsurface objects that minimizes damage to the sensor and apparatus. By having the sensor connected to a reach-in arm, the sensor can reach into hazardous areas while the platform and the operator remain in a safe area. Furthermore, the reach-in arm allows the sensor to search media other than horizontal media. For example, in addition to searching the ground or other horizontal surfaces, the reach-in arm allows the sensor to search vertical media including but not limited to walls, roofs, trees, buildings, cargo containers, trucks, ships, boxes, crates, drums, packages, and the like. Using GPR in or with the sensor or sensors further provides the added benefit of seeing through thick foliage such as tall grass. By having the sensor and the reach-in arm connected by a quick-connect interface, the sensor can quickly and easily be disconnected from the reach-in arm. This facilitates repair should a sensor become damaged or be defective; the sensor merely needs to be removed and replaced rather than replacing the whole platform. Moreover, the quick connect interface can further protect the remainder of the apparatus from damage by allowing for quick and automatic disconnect (i.e. a breakaway system) if the sensor were to impact an object or become irretrievably lodged in a medium that is being explored.

Although the present invention has been described in considerable detail with reference to certain versions thereof, other versions are possible. For example, the apparatus as a whole can be remotely controlled, the reach-in arm can be remotely controlled, the sensor can be remotely controlled, the apparatus can further comprise multiple sensors each sensor capable of sensing a different type of object, the apparatus can include day and night vision cameras, the apparatus can include warning lights that emit light when an object is sensed by the sensor, the apparatus can include warning sounds that are emitted through speakers when an object is sensed by the sensor, etc. Therefore, the spirit and scope of the appended claims should not be limited to the description of the embodiments herein.

What is claimed is:

1. An apparatus for detecting objects on or beneath a surface of a medium comprising:

(a) a platform comprising a vehicle;

(b) a reach-in arm configured as a single arm having a base; wherein the base of said reach-in arm is mounted to said platform;

(c) a ground penetrating radar sensor for sensing objects on or beneath a surface of a medium, wherein said sensor is connected to the distal end of said reach-in arm by a quick connect-interface configured to provide an automatic disconnect of the sensor from the reach-in arm, said quick-connect interface comprising a contact switch breakaway system and a spring mechanism;

(d) at least one motor controller electronically connected to said reach-in arm and to said sensor; said at least one motor controller for controlling the movements of said reach-in arm and said sensor;

(e) a computer in communication with said reach-in arm, said sensor, and said at least one motor controller; said computer:

(i) for processing data received from said sensor to detect objects on or beneath a surface of a medium;

(ii) for controlling the movement of said reach-in arm; and (iii) for controlling the movement of said sensor.

2. The apparatus of claim 1 wherein the base of said reach-in arm is mounted to and extends outwardly from a front end of the platform.

3. The apparatus of claim 1 wherein said reach-in arm comprises a telescopic arm.

4. The apparatus of claim 1 wherein said reach-in arm comprises an articulating arm.

5. The apparatus of claim 1 wherein said reach-in arm comprises a conveyer system.

6. The apparatus of claim 1 wherein said reach-in arm comprises a plurality of segments; each segment connected to a second segment by a joint; said joint providing said computer with distance data used by said computer to control the direction of said reach-in arm and said sensor.

7. The apparatus of claim 1 wherein said reach-in arm is connected to said sensor by a quick connect-interface; said quick-connect interface comprising a contact switch breakaway system and a spring mechanism.

8. The apparatus of claim 1 wherein said sensor and said reach-in arm are configured to search horizontal media and vertical media.

9. The apparatus of claim 1 wherein said reach-in arm is constructed and arranged to extend the sensor into hazardous areas while the platform remains in a safe area.

10. The apparatus of claim 1 wherein said computer is connected wirelessly.

11. The apparatus of claim 1 further comprising a second reach-in arm coupled to said platform; wherein the base of said second reach-in arm is mounted to said platform, said second reach-in arm for physically inspecting a medium or an area surrounding a medium.

12. The apparatus of claim 1 further comprising a second sensor for monitoring the distance of said ground penetrating radar sensor from an object in the path of said ground penetrating radar sensor; said second sensor coupled to said ground penetrating radar sensor and in communication with said computer; said computer for processing data received from said second sensor to determine the distance between said ground penetrating radar sensor and objects in the path of said ground penetrating radar sensor.

13. The apparatus of claim 1 further comprising a marking system connected to said reach-in arm for marking surface of a medium where an object is located; said marking system in communication with said computer for controlling said marking system.

14. The apparatus of claim 1 further comprising a display device in communication with said computer; said display device for displaying data provided by said computer.

15. The apparatus of claim 1 further comprising a camera for capturing images of an area explored by said sensor, wherein said camera is mounted onto the distal end of said reach in arm.

16. The apparatus of claim 15 wherein the camera is capable of night-vision.

17. The apparatus of claim 1 further comprising an input device in communication with said computer; said input device for transmitting instructions to said computer for controlling the movement of said reach-in arm and said sensor; said input device providing instructions to said computer for controlling and moving said reach-in arm and said sensor.

18. A method for detecting objects on or beneath a surface of a medium, the method comprising:

(a) providing a platform comprising a vehicle and a reach-in arm configured as a single arm having a base that is mounted to said platform;

(b) providing a ground penetrating radar sensor for detecting an object on or beneath a surface of a medium; said sensor connected to the distal end of the reach-in arm by a quick connect-interface configured to provide an automatic disconnect of the sensor from the reach-in arm, said quick-connect interface comprising a contact switch breakaway system and a spring mechanism;

(c) moving said reach-in arm in a specified direction to position the sensor over a surface of a medium; and (d) moving said sensor in a specified direction over the surface of a medium in search of an object on or beneath a surface of said medium.

19. The method of claim 18 further comprising:

(a) providing a second sensor coupled to the ground penetrating radar sensor for monitoring the distance between said ground penetrating radar sensor from an object in the path of said ground penetrating radar sensor;

(b) detecting an object in the path of said ground penetrating radar sensor;

(c) determining the distance between said ground penetrating radar sensor and said object in the path of said ground penetrating radar sensor;

(d) moving said reach-in arm in a specified direction in relation to said object in the path of said ground penetrating radar sensor;

(e) moving said ground penetrating radar sensor in a specified direction in relation to said object in the path of said ground penetrating radar sensor.

20. The method of claim 18 further comprising:

(a) providing a marking system coupled to said reach-in arm and said ground penetrating radar sensor;

(b) moving said reach-in arm in a specified direction in relation to said object;

(c) moving said ground penetrating radar sensor in a specified direction in relation to said object;

(d) marking the surface of the medium on or beneath which is located the object.

21. The method of claim 18 further comprising providing override capabilities to a user; wherein the user provides instructions for the direction of moving the reach-in arm or said ground penetrating radar sensor.

22. The method of claim 18 wherein moving said reach-in arm in a specified direction comprises moving said reach-in arm in a pre-programmed sweep direction.

23. The method of claim 18 wherein moving said reach-in arm in a specified direction comprises moving said reach-in arm in a user defined direction around said platform.

* * * * *